US005979200A

United States Patent [19]

Cliff

[11] Patent Number: 5,979,200

[45] Date of Patent: Nov. 9, 1999

[54] AXIAL PIN TUMBLER REMOVABLE CORE LOCK

[75] Inventor: William H. Cliff, Mauldin, S.C.

[73] Assignee: Compx International, Inc., Mauldin, S.C.

[21] Appl. No.: 08/989,992

[22] Filed: Dec. 12, 1997

[51] Int. Cl.[6] ..... E05B 27/00

[52] U.S. Cl. ..... 70/491; 70/368; 70/371

[58] Field of Search ..... 70/267, 268, 271, 70/791, 370, 381

[56] References Cited

U.S. PATENT DOCUMENTS

| | | | |
|---|---|---|---|
| 1,761,092 | 6/1930 | Shin | 70/368 |
| 1,891,214 | 12/1932 | Falk . | |
| 1,913,963 | 6/1933 | Shinn | 70/368 |
| 1,990,934 | 2/1935 | Falk . | |
| 2,019,534 | 11/1935 | Henst | 70/368 |
| 2,061,456 | 11/1936 | Falk . | |
| 2,292,515 | 8/1942 | George | 70/371 |
| 3,261,188 | 7/1966 | Kerr | 70/491 |
| 3,526,111 | 9/1970 | Jacobi | 70/371 |
| 3,681,955 | 8/1972 | Sturgeon | 70/491 |
| 4,398,405 | 8/1983 | Patriquin . | |
| 4,416,129 | 11/1983 | Thimot . | |
| 4,484,462 | 11/1984 | Berkowitz | 70/368 |
| 4,672,827 | 6/1987 | Craig . | |
| 5,105,637 | 4/1992 | Kovens | 70/491 |

*Primary Examiner*—Darnell M. Boucher
*Attorney, Agent, or Firm*—Banner & Witcoff, Ltd.

[57] ABSTRACT

A removable core, axial pin tumbler lock includes an inner cylinder assembly which is retained within a housing for the lock by means of a spring biased disc which may be decoupled from the housing by means of insertion of a pick through a passageway defined in the inner cylinder assembly when the components parts of the assembly are appropriately aligned.

1 Claim, 3 Drawing Sheets

FIG.3
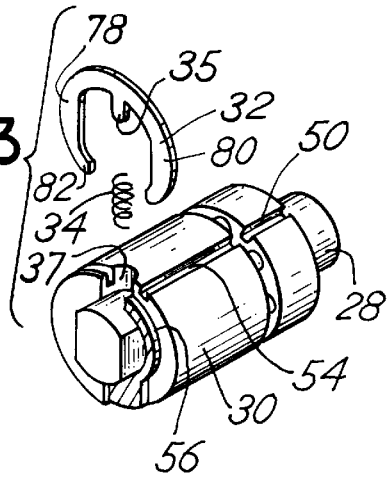
FIG.4a
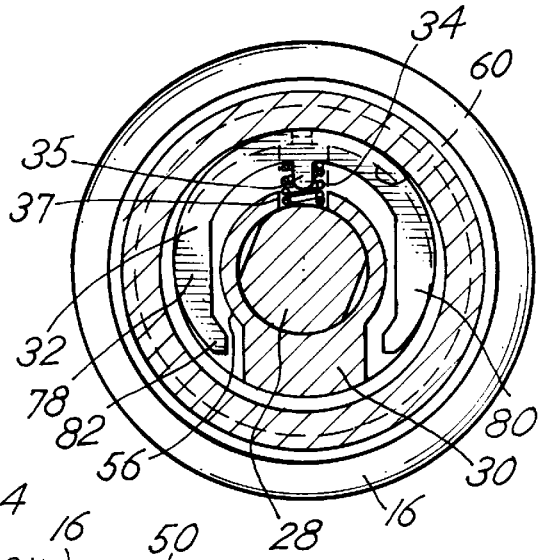
FIG.4
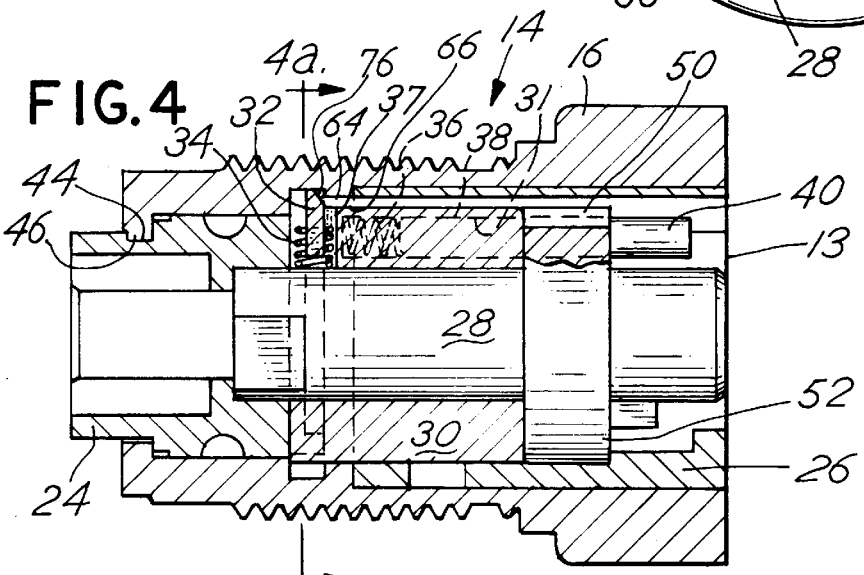
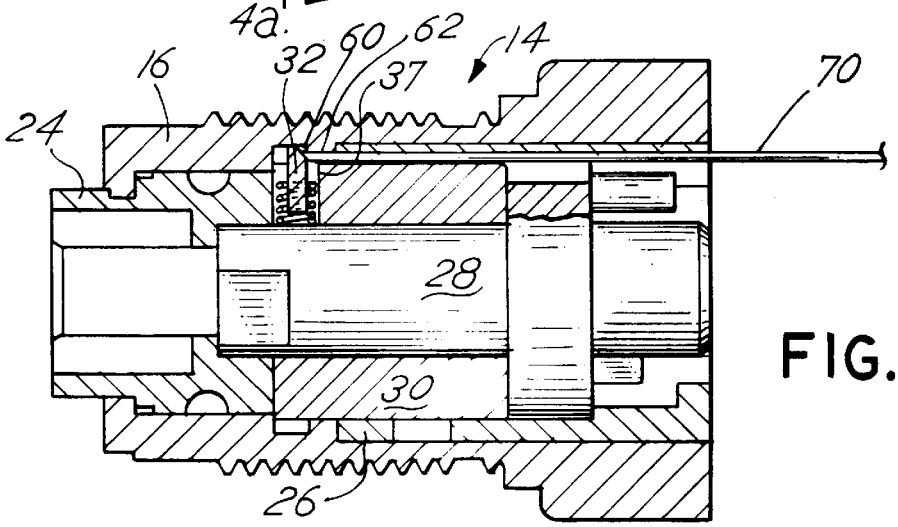
FIG.5

AXIAL PIN TUMBLER REMOVABLE CORE LOCK

BACKGROUND OF THE INVENTION

This invention relates to an axial pin tumbler lock which includes a removable core.

Axial pin tumbler locks are useful, particularly for cabinet drawers and the like. Often the installation of an axial pin tumbler lock requires replacement of the locking mechanism for various reasons. For example, the keys for the lock may have been duplicated and it is desired, for security reasons, to change the combination. Further, the lock housing may be attached to cabinetry or some other fixture without the locking mechanism. Then the fixture and lock housing may be further processed before the locking mechanism is inserted or incorporated with the lock housing. Thus there has developed a need to provide a removable core, axial pin tumbler lock wherein the key combination associated with the lock may be altered by replacement of the core of the lock while the cylinder or housing for the lock remains affixed to a cabinet, drawer or the like.

SUMMARY OF THE INVENTION

Briefly, the present invention comprises an axial pin tumbler lock with a removable core. The lock includes a cylinder or housing with a generally cylindrical throughbore adapted to receive an inner cylinder assembly which includes an axial pin locking mechanism. The inner cylinder assembly is axially slidable into the cylinder or housing and is aligned in a desired orientation by virtue of the compatible generally congruent shape of the outer surface of the inner cylinder assembly and the shape of the inner passage of the cylinder or housing. The inner passage of the housing further includes an annular slot or groove at one end on the inside surface. The slot is defined by a flange projecting radially inward from the inside wall or surface of the inner passage of the housing. A small axial opening or passage is defined in the flange.

The inner cylinder assembly is axially slidable into the throughbore of the cylinder or housing and includes a transversely slidable retainer disc mounted thereon with a spring for biasing the retainer disc radially outward into the annular slot or groove in the inner passage of the housing. The disc is thus biased to retain the inner cylinder assembly attached or fixed to the cylinder or housing. The inner cylinder assembly further includes the locking mechanism which comprises an outer sleeve, a plug or barrel within the sleeve, said plug including biased axial tumblers in tumbler passages, and a rotatable spindle with axially slidable tumblers mounted in axial passageways in the spindle. The spindle of the inner cylinder assembly is designed to be attached to a shifter that connects with a bolt or cam, for example. The ends of the axial tumblers are alignable along a transverse plane in response to a bitted key that axially moves and aligns tumblers along the transverse or shear plane between the plug and spindle, thereby permitting rotation of the spindle relative to the plug within the sleeve of the inner cylinder assembly. The spindle may thus be rotated to a particular position, for example, an unlocked position. When so aligned, it is possible to insert a pick or probe through aligned axial passageways defined in the outer surface of the plug and spindle of the inner cylinder assembly. The probe also may be fitted through the opening or passage in the flange on the inside passage of the housing cylinder so as to engage the retainer disc and move the disc against the biasing force of the spring. This releases the retainer disc from the housing slot permitting removal of the inner cylinder assembly or core from the housing. A substitute inner cylinder assembly may then be inserted by reversing the process.

Thus, it is an object of the invention to provide an axial pin tumbler lock which includes a removable core.

A further object of the invention is to provide an axial pin tumbler lock which allows cabinet makers to preassemble an outer cylinder housing, shifter and cam or bolt to the cabinet product and subsequently insert a locking mechanism or core into the housing during a final assembly or final manufacturing stage or in the field.

Yet a further object of the invention to provide for an axial pin tumbler lock which may be rekeyed in the factory or in the field. Such rekeying can be effected without removal of the entire cylinder or housing and cam or bolt associated with the lock.

A further object of the invention is to provide an improved axial pin tumbler lock which is economical to manufacture, easy to use and easy to install.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 3 is an isometric view illustrating portions of the inner cylinder assembly or core mechanism for retaining the inner cylinder assembly or core within the cylinder or housing of the lock;

FIG. 4 is a side cross-sectional view of the lock illustrating the construction of the inner cylinder assembly or core in combination with the cylinder or housing prior to insertion of a picking tool;

FIG. 4*a* is a cross sectional view taken along the line 4*a*—4*a* in FIG. 4;

FIG. 5 is a side cross-sectional view similar to FIG. 4 wherein a picking or core removal tool has been positioned to release the inner cylinder assembly or core;

DESCRIPTION OF THE PREFERRED EMBODIMENT

Figure 1:
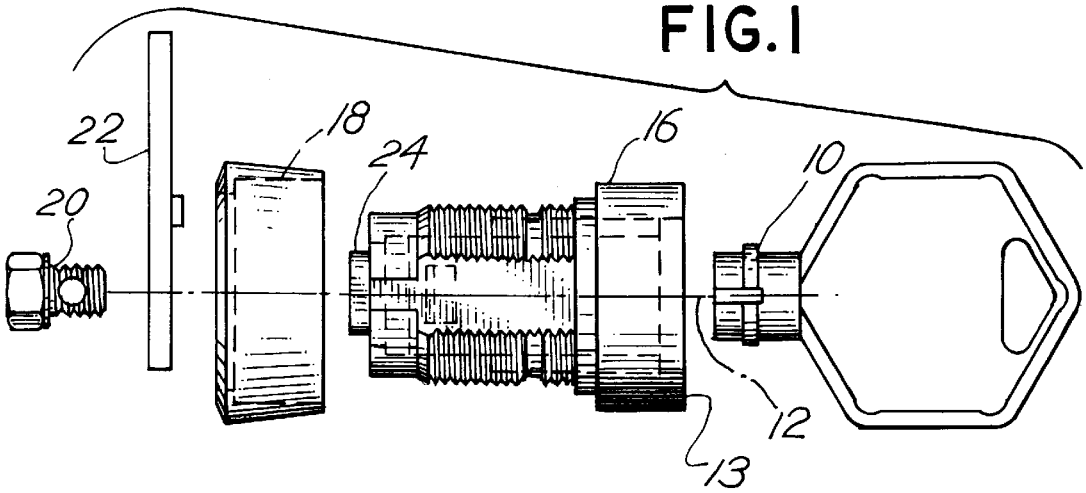
FIG. 1 is an exploded side view of the component parts comprising the lock of the invention.
Figure 2:
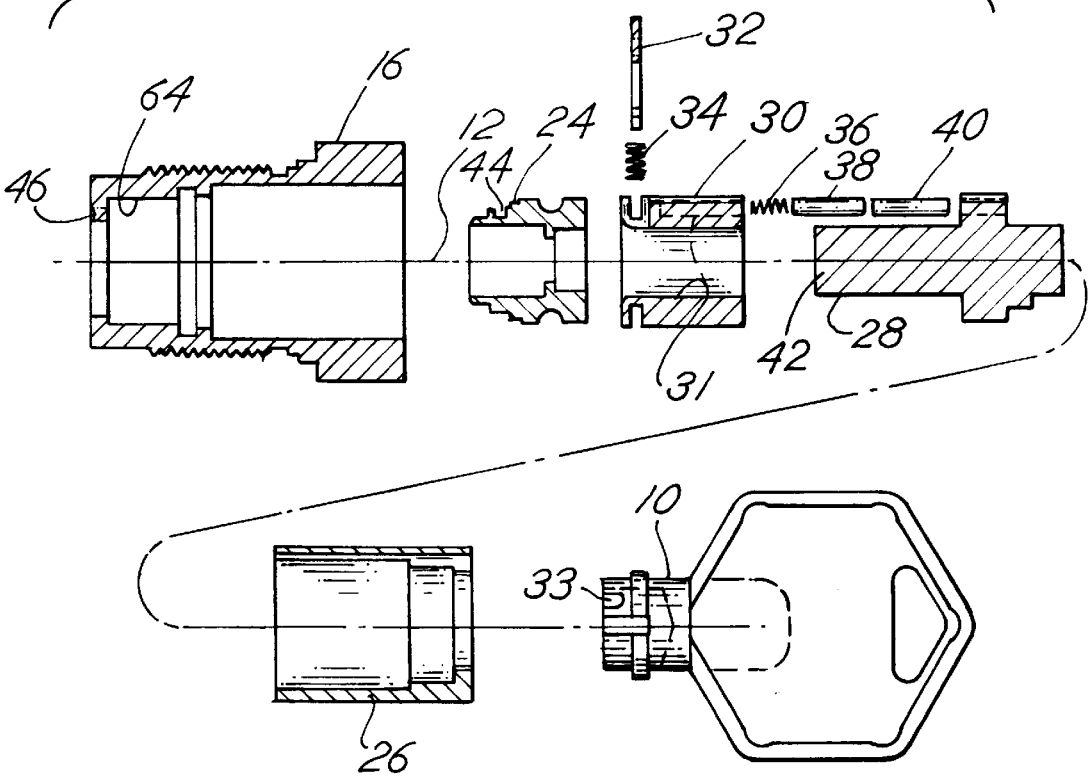
FIG. 2 is a cross sectional exploded view of the lock of FIG. 1.

Referring to the figures, and in particular FIGS. 1 and 2, there is depicted the general layout of the improved removable core, axial pin tumbler lock of the invention. The lock includes a key 10 which, when in position for use, is aligned along a centerline axis 12 of the lock components and is positioned for insertion into the key entry end 13 of lock 14. The lock 14 has an outer housing or cylinder 16 which may be externally threaded for cooperation with a fastener (not shown) for retention in a cabinet, drawer or the like. Alternatively, a cap or other fastening device 18 may be cooperative with the outside surface of the housing 16 so as to hold the lock 14 in position in a cabinet or the like. A screw fastener 20 holds a cam or bolt 22 in communication with and fastened to a drive shifter 24 which is rotatably mounted in the housing 16. Insertion of the proper key 10 into the lock 14 to properly move and align tumblers so as to permit rotation of the lock core and operation of the lock 14 between the locked and unlocked position also causes the cam 22 and shifter 24 to be rotated so as to effect the appropriate locking operation by the lock 14.

Referring to FIG. 2, there is illustrated in greater detail the component parts of the lock 14 in an exploded, side cross-sectional view. The cylinder or housing 16 slidably receives an inner cylinder assembly or core. The inner cylinder assembly is comprised of a sleeve 26 into which a rotatable spindle 28 is inserted. An end plug 30 is also slidably inserted in housing 16. Plug 30 includes a through passage 31 for rotatable receipt of spindle 28. A transverse disc 32 biased by a spring 34 is mounted on plug 30. Plug 30 is keyed or fixed to the sleeve 26 and sleeve 26 is keyed to the housing 16 so that it is non-rotatable. The plug 30 includes a plurality of springs 36 and tumblers 38. Spindle 28 also includes pin tumblers 40. That is springs 36 and axial tumblers 38 are included in cylindrical tumbler passages 31 of the plug 30 and are arranged concentrically and radially spaced about axis 12. Tumblers 40 associated with spindle 28 are similarly positioned around axis 12. The axial pin tumblers 38 and 40 are generally operative in a fashion known to those of skill in the art. That is, the key 10 includes detents 33 which engage the tumblers 40 in the spindle 28 aligning those tumblers 40 with a separation line or shear plane transverse to the axis 12 between spindle 28 and plug 30 so that the spindle 28 may be rotated relative to the plug 30. Rotation of the spindle 28 causes rotation of the shifter 24 inasmuch as the spindle 28 includes a center rod 42 which is keyed to and engaged with the shifter 24 thereby causing the shifter 24 to rotate as the spindle 28 is rotated. Shifter 24 is rotatable relative to housing 16 and is retained by housing 16 as described below.

Thus, the cam or bolt 22, which is attached to the shifter 24 by a screw or fastener 20, will be rotated as the shifter 24 is rotated. The shifter 24 includes a slot 44 which receives a tab 46 projecting radially inward from the inside through-bore surface 64 of the housing 16 to retain the shifter 24 in place within the housing 16. The slot 44 extends partially circumferentially about the shifter 24 and during normal operation and rotation of the shifter 24, the shifter tab 46 will remain engaged with the slot 44. Assembly of the shifter 24 is effected by inserting the shifter 24 into the housing 16 in an orientation wherein the shifter slot 44 is not aligned with tab 46. The shifter 24 may then be rotated to engage the depending tab 46 with slot 44. During normal operation of the lock 14, the shifter 24 then rotates a limited amount so that tab 46 and slot 44 remain engaged.

In review, the lock 14 includes a removable inner cylinder assembly comprised of the sleeve 26, spindle 28, plug 30, disc 32 and spring 34 as described above. Removability is effected by means of a pick or probe 70 which engages the disc 32 moving it against the biasing force of spring 34 to release the inner cylinder assembly or core from the housing 16. Thus disc 32 fits over a hub 56 defined at the end of the plug 30, and disc 32 is biased radially outward from the hub 56 and axis 12 by the spring 34. The disc 32, as depicted in FIG. 3, includes opposite side legs 78 and 80 which fit on opposite sides of the hub 56. Spaced, inwardly extending lugs 82 of disc 32 fit around the hub 56 and are spaced to thereby retain the disc 32 on the hub 56. As depicted in FIG. 3, the disc 32 is biased by the spring 34 mounted on a depending prong 35 fitted into a guide opening 37 in hub 56. Disc 32 is biased into a circumferential slot 60 defined on the inside surface or passage of the housing 16 by a circumferential, radially inwardly extending flange 62 which extends around the inside surface 64 of the housing 16.

The flange 62 includes an axial passageway or opening 66 which is aligned with a passageway 54 on the outside surface of the plug 30. This alignment is achieved by appropriately providing a keying or aligning relationship between the inner cylinder assembly, and more particularly the sleeve 26, and the inside surface 64 of the housing 16. For example, both the inner cylinder assembly and the housing 16 may include compatible or congruent flats or flat surfaces or other shaped surfaces which provide for the appropriate, non-rotatable alignment of the sleeve 26 relative to the housing 16. Such alignment then ensures that the opening or passage 66 is appropriately aligned with the opening or passage 54 in the plug 30. Passage 54 or groove 54 extends axially the axial dimension or length of plug 30. As depicted in FIG. 4, the disc 32 is positioned to retain the inner cylinder assembly including the sleeve 26 and other component parts retained therein within the housing 16.

Spindle 28 includes a flange 52 with tumbler passages and tumblers as described above and depicted. The diameter of flange 52 preferably equals the diameter of plug 30. The spindle 28 is rotatable and, in order to effect removal of the core or locking cylinder assembly, needs to be appropriately aligned so that a slot or groove 50 on its outer surface becomes aligned with the groove 54 and the passage or opening 66. When so aligned, a pick such as pick 70, which includes a rod 72 having a point or probe 74, may be inserted from the front of the lock through the aligned groove 50 and then through the groove 54 and the opening or passage 66. The point 74 of the rod 72 can then engage against a chamfered surface 76 of the disc 32 and thereby move the disc 32 radially inward and transverse to the axis 12 against the biasing force of the spring 34 to release the disc 32 from the engagement with the flange 62. Thus, movement of disc 32 releases disc 32 from slot 60 and permits axial movement of the inner cylinder assembly. The diametral dimension of the disc 32 is less than the internal diameter associated with the flange 62 of the housing 16. Consequently, when the disc 32 is appropriately radially moved by pick 70, it does not interfere with the flange 62 and the inner cylinder assembly may be easily removed.

Figure 6:
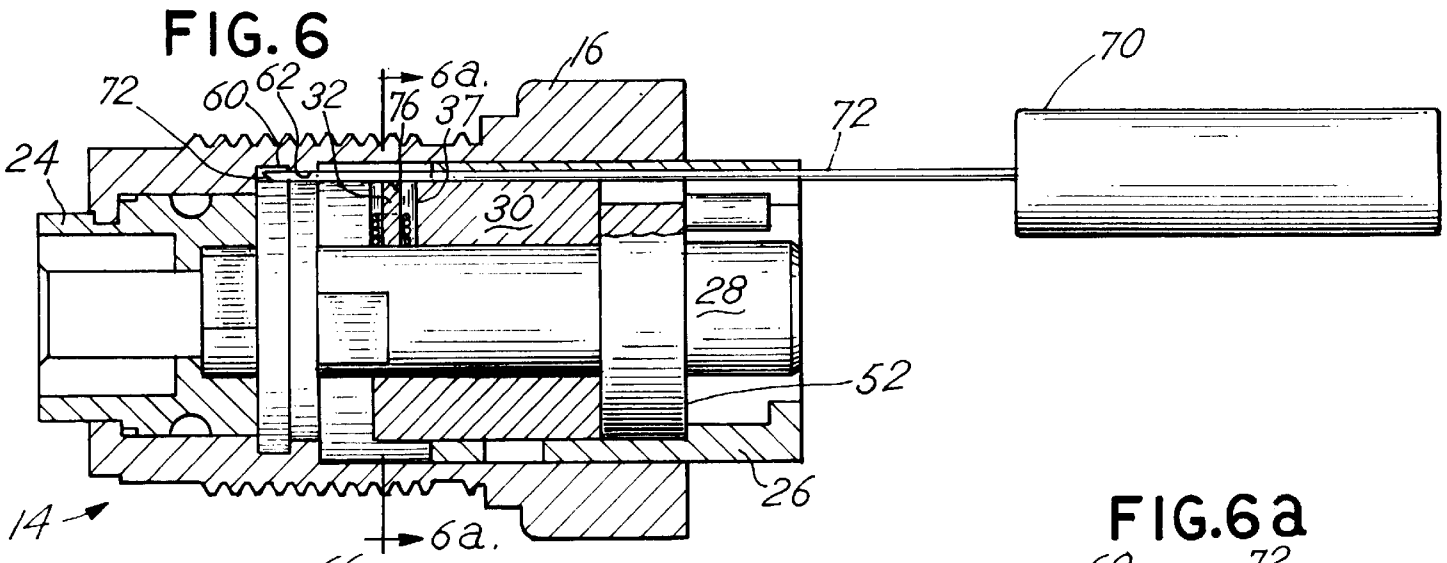
FIG. 6 is a side cross-sectional view similar to FIG. 5 wherein the inner cylinder assembly has been released and is partially removed from cylinder or housing.
Figure 6A:
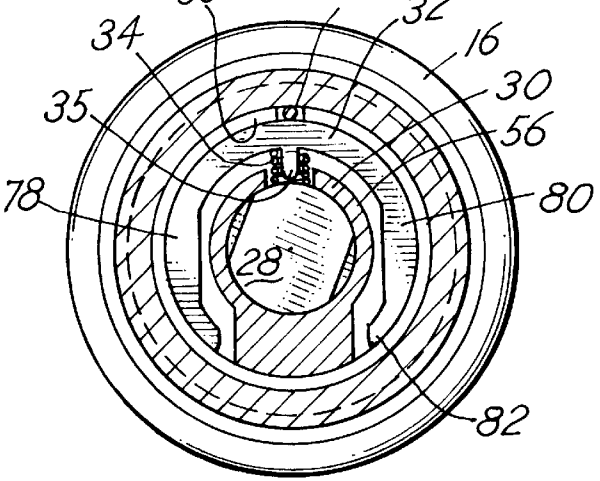
FIG. 6*a* is a cross sectional view taken along the line 6*a*—6*a* in FIG. 6.
Figure 7:
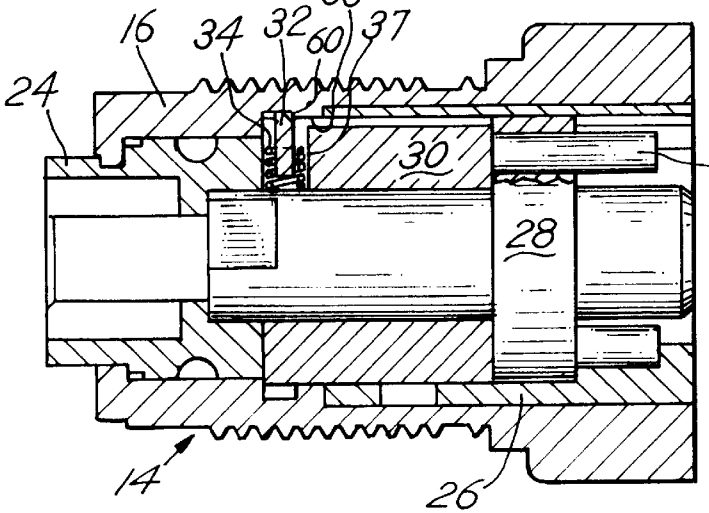
FIG. 7 is a figure similar to FIG. 4 wherein the inner cylinder is positioned within the housing and wherein the spindle and plug have been rotated so as to preclude insertion of the picking tool.

FIG. 5 illustrates the position of the pick 70 as inserted into the lock 14 so as to engage the chamfered surface 76 and effect radial or axially transverse, unlocking movement of the disc 32. FIG. 6 illustrates the next sequential step, namely the axial sliding movement of the inner cylinder assembly along the axis 12 for removal. The inner cylinder assembly may thus be removed and replaced with a cylinder assembly having a different set of tumblers and thus a different combination for actuation by a different key.

It is possible to vary the construction of the invention by utilizing, for example, disc constructions and spring biasing constructions of different size, shape and configuration. Additionally, the construction of the flange 62 and the arrangement of the passage 66 through the flange 62 and the position size and alignment the plug and spindle passages 54 and 50 as well as the orientation of those passages may all be varied while still being within the scope of the invention. The invention is, therefore, to be limited only by the following claims and equivalents.

What is claimed is:

1. An axial pin tumbler lock with a removable core comprising, in combination:

(a) a cylinder housing with a generally cylindrical throughbore defining an inside surface, a longitudinal axis, and at least one non-cylindrical surface on the inside surface, an annular slot in the inside surface defined by an inwardly extending, radial flange, said flange including at least one passage therethrough, said flange extending around the inside surface of said cylinder housing; and (b) a removable inner cylinder assembly axially slidable into the throughbore, said assembly including;

(i) a slidable spring retainer disc, said slidable spring retainer disc including spaced legs slidably fitted over a hub of the removable inner assembly, said slidable spring retainer disc mounted on the removable inner cylinder assembly transverse to the axis, (ii) a spring for biasing the slidable spring retainer disc radially outward into the annular slot to retain the removable inner cylinder assembly, (iii) a sleeve with a rotatable spindle having axial tumblers in the rotatable spindle alignable along a transverse plane in response to a bitted key to permit rotation of the rotatable spindle within the sleeve of the removable inner cylinder assembly between a locked and unlocked position, said rotatable spindle including an axial bore for receipt of a driving pick, and (iv) a plug rotatable to align the axial bore and flange passage thereby with an edge of the slidable spring retainer disc in the annular slot in the cylinder housing to permit the pick to engage the slidable spring retainer disc and move the slidable spring retainer disc counter to the force of the spring, said axial bore parallel to said cylindrical throughbore and defined between said plug and said rotatable spindle, whereby the removable inner cylinder assembly may be removed from the cylinder housing by insertion of the driving pick into the axial bore.

* * * * *